US005167836A

United States Patent [19]

Kylliäinen et al.

[11] Patent Number: 5,167,836

[45] Date of Patent: Dec. 1, 1992

[54] METHOD FOR CONTROLLING PRESS FILTER MOTORS WITH A FREQUENCY CONVERTER

[75] Inventors: Mauno Kylliäinen; Erkki Näätänen; Petri Saira, all of Lappeenranta, Finland

[73] Assignee: Larox Oy, Lappeenranta, Finland

[21] Appl. No.: 723,922

[22] Filed: Jul. 1, 1991

[30] Foreign Application Priority Data

Jun. 29, 1990 [FI] Finland ..... 903316

[51] Int. Cl.[5] ..... B30B 15/26

[52] U.S. Cl. ..... 210/767; 100/37; 100/45; 100/48; 210/138; 210/141; 210/224

[58] Field of Search ..... 210/138, 143, 224, 739, 210/767, 141; 388/908; 318/3-5; 100/35, 434, 45, 37, 48

[56] References Cited

U.S. PATENT DOCUMENTS

| | | | |
|---|---|---|---|
| 4,627,914 | 12/1986 | Antonenko | 210/138 |
| 4,659,483 | 4/1987 | Gries | 210/224 |
| 4,816,723 | 3/1989 | Shields et al. | 388/908 |

FOREIGN PATENT DOCUMENTS

| | | | |
|---|---|---|---|
| 238356 | 8/1986 | Fed. Rep. of Germany | 100/43 |
| 3613844 | 10/1987 | Fed. Rep. of Germany | 210/224 |
| 57-71617 | 5/1982 | Japan | 210/739 |
| 59-94600 | 5/1984 | Japan | 100/48 |
| 61-138510 | 6/1986 | Japan | 210/767 |
| 2-25298 | 1/1990 | Japan | 100/48 |
| 1111245 | 8/1984 | U.S.S.R. | 318/5 |
| 1212495 | 2/1986 | U.S.S.R. | 210/224 |

*Primary Examiner*—Mary L. Theisen
*Assistant Examiner*—Joseph Drodge
*Attorney, Agent, or Firm*—Lorusso & Loud

[57] ABSTRACT

The invention concerns a method for controlling a press filter, said press filter having electric motors for operating said press filter. At least one of said electric motors of said press filter is driven by a frequency filter. A logic control unit is used for sending a program-controlled analog signal to said frequency converter. The output current from said frequency converter having a frequency proportional to the magnitude of said analog signal received from said logic control unit is used for driving the press filter's electric motors, whose rotational speeds thereby become proportional to the drive current frequency. A desired electric motor is individually started by way of applying power to the motor via a switch element which is activated by a signal from the logic control unit.

4 Claims, 3 Drawing Sheets

METHOD FOR CONTROLLING PRESS FILTER MOTORS WITH A FREQUENCY CONVERTER

Figure 1:
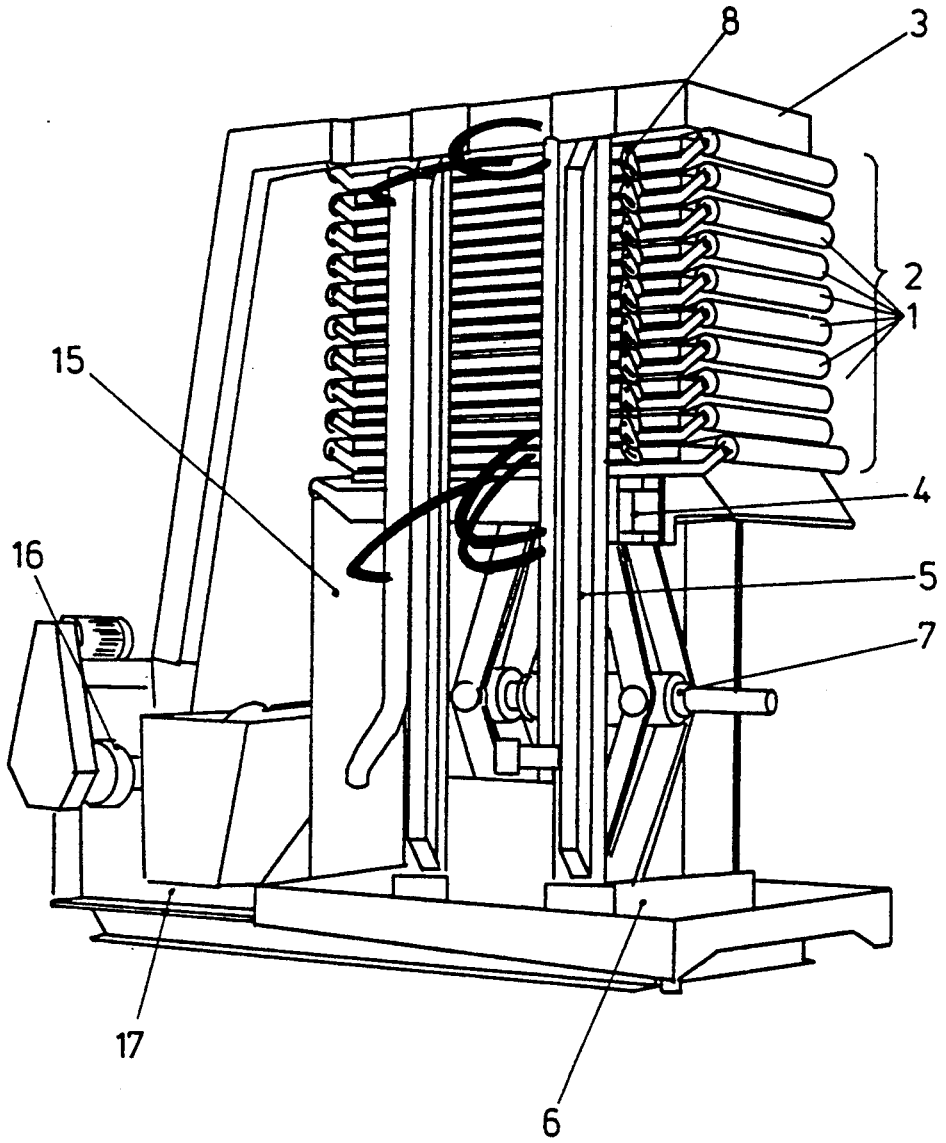

The present invention relates to a method for improving the mechanical functions of press filters by means of a frequency converter.

Press filters are used in the process industry for separating liquids from solids. Such processes include, e.g., the handling of concentrates in the mining industry, filtration of different types of wastewaters, various processes of the chemical industry, etc.

A typical press filter equipped with horizontal filter plates is comprised of a stack of superimposed filter plates, each intermediate space between the plates containing a filter chamber delineated at least on its one side by a filter fabric. The slurry to be deliquefied is routed to the filter chamber, where it is pressed with the help of a pressing medium such as pressurized water, which is routed behind a separate pressing membrane, in order to separate liquid from the solids. Next, the solids cake thus formed can be washed by routing washing liquid into the filter chamber, after which the washing liquid can be removed by repeating the press phase. Then, the solids cake is dried by routing pressurized gas, conventionally compressed air, into the filter chamber, whereby the gas flow through the solids cake reduces the cake's water content. Finally, the filter plate stack is opened and the formed solids cakes are removed from atop the filter plates on a filter fabric belt moved by a drive apparatus the fabric.

The press filter is sequentially operated, whereby the phases of a typical filtration cycle include the closing of the filter, filtration, membrane pressurization, an optional wash complemented with a second press phase, air drying, opening the filter and removal of the solids cakes. The total time of the cycle is typically in the order of 8 to 12 minutes of which time the opening and closing of the filter by means of electric-motor-driven actuators, including the transfer of the filter fabric during the emptying and washing phase, totally consume about 4 minutes.

An electric motor actuating the closing apparatus is naturally dimensioned according to maximum torque needed. Due to the structure of a closing apparatus constructed with the help of a pivoted lever mechanism, the necessary torque varies according to changes in the lever angles. Therefore, the electric motor is "overdimensioned" for a major part of the operating sequence of the closing apparatus.

The filter fabric is moved by a pull apparatus, whose pull force is dimensioned according to the force needed during the emptying phase of the filter. When the solids cake has fallen off from the filter fabric, the pull resistance imposed by the fabric on the motor is relieved, and consequently, thereinafter the motor has an "overdimensioned" power capacity for the washing phase of the filter fabric.

Pressing of the filter cakes takes place by means of pressurized water routed behind the rubber pressing membranes, whereby the elevated water pressure is achieved with the help of a centrifugal pump driven by a constant RPM electric motor. If a lower pressure for compression is desired, the relief pressure threshold of the pressure-regulating valve is adjusted to a lower value.

In is an object of the present invention to overcome the above-described drawbacks. The characterizing features of the method used according to the invention for driving the electric motors of a press filter are disclosed herein. The method according to the present invention can significantly improve the filtration capacity of a press filter in respect to a conventional operating method described in the above text.

A frequency converter can be utilized for controlling the rotational speed of conventional constant RPM electric motors, preferably squirrel-cage induction motors, whereby the rotational speed of the electric motors can be increased during low-load periods, thus making it possible to shorten the total cycle time of filters. The achieved reduction in the total cycle time offers a corresponding improvement in the operating capacity of the filter. The rotational speed of the closing apparatus can be increased during the low-load periods in the opening and closing phases, whereby the total operating cycle of the filter is reduced. The speed of the pull apparatus moving the filter fabric can be increased as soon as the solids cakes have fallen off from the fabric belt, thus relieving the pull force requirement. This in turn permits shortening the time used for washing the fabric, because the fabric is moved faster past the fixed washing point. The speed of the pressure-elevating pump of the pressing water circuit can be increased during the fill phases of the pressure spaces behind the pressing membranes, whereby the start of the actual press phase can be accelerated. On the other hand, the speed control of the motor makes it possible to achieve a desired pressing pressure without resorting to separate pressure-regulating devices.

If the total time of the filtration cycle is 600 s, the opening and closing of the filter consumes 120 s, and the washing of the filter fabric equally consumes 120 s. By means of the frequency converter, the total time of the opening and closing of the filter can be brought down to 80 s and the washing time of the filter fabric down to 70 s. Thus, the total cycle time is reduced to 90 s, that is, by 15%. In practice, this means a corresponding increase in the operating capacity of the filter.

Figure 2:
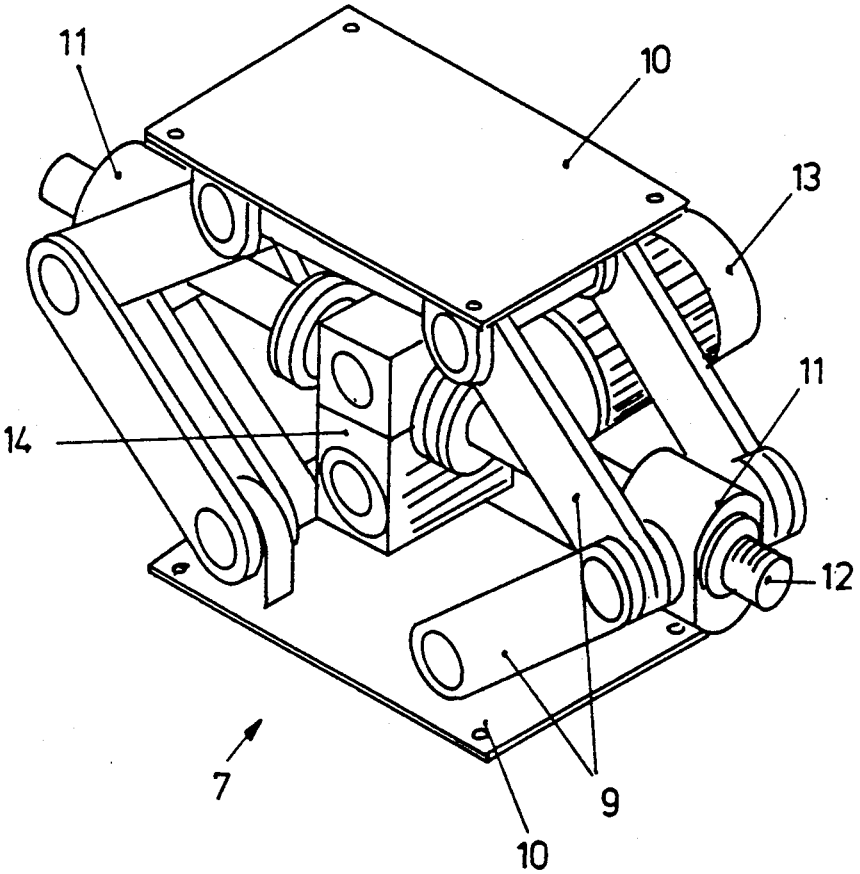
Figure 3:
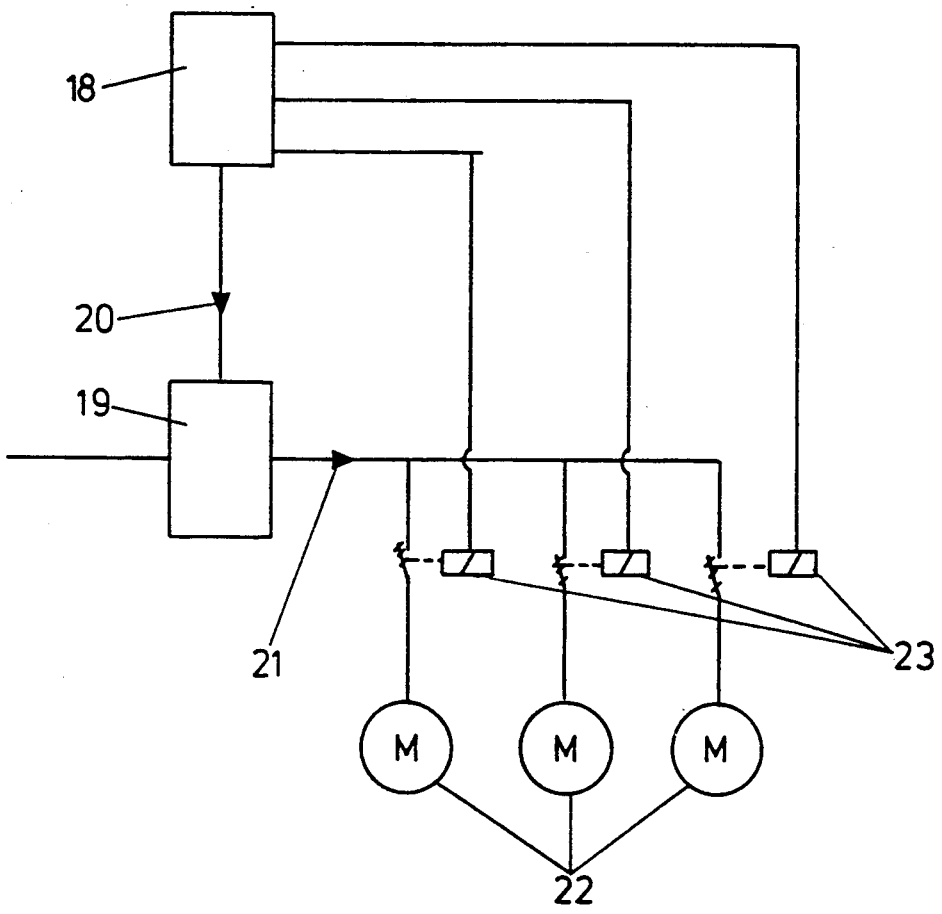

The invention is next examined in greater detail with the help of an exemplifying embodiment illustrated in the attached drawings, in which FIG. 1 shows the general construction of a press filter, FIG. 2 shows the construction of the mechanical closing apparatus of a press filter, and FIG. 3 shows the operating principle of the motor control according to the invention for the electric motors of a press filter.

A typical press filter equipped with horizontal filter plates is comprises of a stack (2) of superimposed filter plates (1), the stack being placed between a stationary (3) and a movable pressing plate (4). The stationary pressing plate (3) is attached by vertical posts (5) to a base plate (6).

Between the base plate (6) and the movable pressing plate (4) is placed a closing apparatus (7) with which the pressing plates (1) can be tightly pressed against each other during the filtration phase. For the removal of the solids cakes, the closing apparatus (7) lowers the movable pressing plate (4), whereby the filter plates (1) attached to each other by means of links (8) remain equidistantly spaced in respect to each other.

The mechanical closing apparatus (7) comprises pivotally mounted levers (9) which are attached at their one ends to support plates (10) and at their other ends to nuts (11) of opposite-handed threads. The nuts are connected by a right- and left-handedly threaded screw (12) which is driven by an electric motor (13) via a reduction gear (14). By changing the rotational direction of the electric motor (13), the support plates (10) can be made to approach each other during the opening phase of the pressing plate stack (2), and correspondingly, to move apart from each other during the closing phase of the pressing plate stack (2).

Running as an endless belt between the pressing plates (1), there is placed a filter fabric (15) which during the removal phase of the solids cakes is moved by a pull apparatus (16) thus discharging the formed solids cakes on both sides of the filter. As the filter fabric moves, it is washed with the help of wash jets (17) placed in front of the pull apparatus.

The filter operation is typically controlled with the help of a programmable logic control which takes care of the opening and closing of the actuator-operated valves as well as the starting of the electric motors controlled by programmed timing sequences and information obtained from feedback signals.

As shown in FIG. 3, a programmable logic control unit (18) sends a program-controlled analog signal (20) (e.g., a voltage signal of 0 . . . 10 V) to a frequency converter (19). The output current (21) having a frequency (e.g. in the range 25 . . . 120 Hz) proportional to the magnitude of the analog signal (20) received from the logic control is utilized for powering the filter's electric motors (22), whose rotational speeds thereby become proportionally controlled by the frequency. A desired electric motor is started when a motor-starting relay (23) is activated by the logic control, thus powering the motor circuit.

The analog signal from the logic control unit can be altered as necessary, whereby the acceleration and retardation ramping of motor speeds can be adjusted individually according to drive needs.

The arrangement shown in FIG. 3 makes it possible to use a single frequency converter for alternate control of several motors (e.g., the opening motor of the filter, the drive motor of the filter fabric, the squirrel-cage induction motor of the centrifugal pump). The output frequency range of the frequency converter used for individually driving the motors is advantageously variable in the range 25 . . . 120 Hz. Of course, simultaneous drive to several motors is possible, but then the frequency of the output current to the motors id obviously identical. Furthermore, it is possible to drive only a portion of the motors via the frequency using motor-specific frequency converters for each of the motors.

For those versed in the art it is evident that the invention in not limited by the exemplifying embodiment described above, but instead, its applicability can be varied within the scope of the enclosed claims.

What is claimed is:

1. A method for controlling a press filter, said press filter having a plurality of electric motors for operating said press filter, comprising driving at least two of said electric motors of said press filter by a common frequency converter using a frequency range, individually adjustable for each of said electric motors by way of applying power via switch elements placed respectively in front of each said motor, each of said switch elements being in communication with one of said motors.

2. A method for controlling a press filter, said press filter having a plurality of electric motors for operating said press filter, comprising driving at least two of said electric motors of said press filter by a common frequency converter using a frequency range, individually adjustable for each of said electric motors.

3. A method for controlling a press filter, said press filter having a plurality of electric motors for operating said press filter, comprising driving at least one of said motors respectively driving a closing apparatus, a filter fabric moving apparatus and a pressure-elevating unit of a pressurized water circuit of said press filter by a common frequency converter.

4. A method for controlling a press filter, said press filter having a plurality of electric motors for operating said press filter, comprising driving each of said electric motors of said press filter by a common frequency converter using a frequency range individually adjustable for each of said electric motors by way of applying power via switch elements placed respectively in front of each of said motors, each of said switch elements being in communication with one of said motors.

* * * * *